United States Patent [19]

Thieme

[11] Patent Number: 4,564,240

[45] Date of Patent: Jan. 14, 1986

[54] LOUNGER OR RECLINING CHAIR MADE FROM A FLOATABLE PLASTIC BODY

[76] Inventor: Gerd Thieme, Auf der Wildbahn 2, 5060 Bergisch Gladbach, Fed. Rep. of Germany

[21] Appl. No.: 543,514

[22] Filed: Oct. 18, 1983

[30] Foreign Application Priority Data

Oct. 23, 1982 [DE] Fed. Rep. of Germany ... 8229761[U]

[51] Int. Cl.[4] ..... A47C 7/02

[52] U.S. Cl. ..... 297/457; 297/460; 297/DIG. 2; 441/129

[58] Field of Search ..... 297/457, DIG. 2, 460, 297/458; 441/127, 130, 131, 132, 126

[56] References Cited

U.S. PATENT DOCUMENTS

| | | | |
|---|---|---|---|
| 3,038,175 | 6/1962 | Faget et al. | 297/DIG. 2 |
| 3,102,280 | 9/1963 | Williams | 441/130 |
| 3,117,327 | 1/1964 | Mathew | 297/457 |
| 3,363,272 | 1/1968 | Channon | 441/129 |
| 3,620,570 | 11/1971 | Wilson | 441/126 |
| 3,775,782 | 12/1973 | Rice et al. | 441/129 |
| 3,848,925 | 11/1974 | Harder, Jr. | 297/DIG. 2 |
| 3,860,976 | 1/1975 | Suyama | 441/131 |

*Primary Examiner*—Francis K. Zugel

*Attorney, Agent, or Firm*—Browdy and Neimark

[57] ABSTRACT

The invention relates to a lounger or reclining chair made from a rigid plastic body with a continuous supporting surface. The lounger or reclining chair must be floatable and at the same time must possess the good qualities of erectable loungers or reclining chairs, so that the user can float on the water in a comfortable and restful position on the water with the lounger or reclining chair. For this purpose, the floating body has been designed to be floatable and is provided with at least one cavity which is enclosed on all sides, in order to produce the buoyancy. The top surface of the plastic body, which acts as a supporting surface, has a depression which is adapted to the shape of a human body.

8 Claims, 4 Drawing Figures

LOUNGER OR RECLINING CHAIR MADE FROM A FLOATABLE PLASTIC BODY

Figure 1:
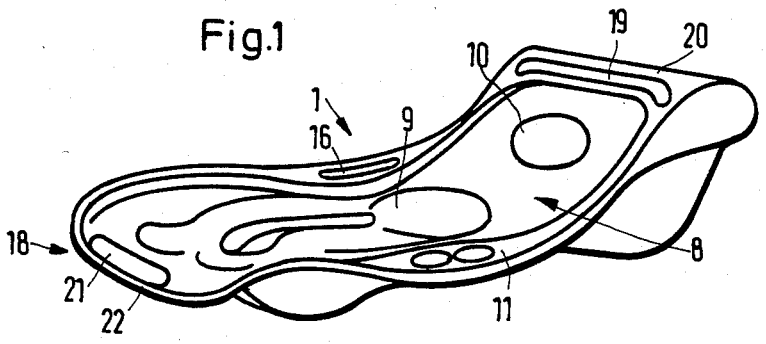

The invention relates to a lounger or reclining chair made from a rigid plastic body with a continuous supporting surface.

Loungers and reclining chairs of the above-mentioned kind, on which one can comfortably sit, lie and rest, are known in many designs.

In addition, there are inflatable, floatable loungers which can be used to lie on the water. These inflatable loungers, however, have the drawback that they are very unstable, do not afford a comfortable resting position and furthermore are washed over even by small waves.

The object of the invention is to create a lounger or reclining chair which combines the good qualities of erectable loungers or reclining chairs with those of floatable inflatable loungers so that the user can also float on the water in a comfortable and restful position with the lounger or reclining chair.

Using as a basis a lounger or reclining chair made from a rigid plastic body, this object is achieved by designing the plastic body so that it is floatable and by providing it with at least one cavity which is enclosed on all sides, in order to produce the required buoyancy.

As a result of the invention, it is possible to lie comfortably and completely relaxed on the floating lounger or floating reclining chair, whereby the swaying effect leads to a demonstrable calming of the nerves. In particular, such floatable loungers or reclining chairs can be used in private swimming pools, on hotel beaches or in the countryside for the purpose of relaxation.

Preferably the plastic body consists of two single-piece half-shells which are connected in a watertight manner to each other and form a continuous cavity between them. Such a plastic body can be manufactured easily and without problems, the cavity being formed automatically by the joining together of the half-shells.

Under the back area and under the foot area the the cavity may, in each case, have a bulge, in order to distribute the buoyancy evenly over the body resting on the lounger.

For safety reasons as well as to increase the rigidity of the lounger or reclining chair, the cavity can be filled with floatable material. Expanding material is particularly suitable for this purpose and can be easily packed into the cavities.

The top surface of the floating body, which acts as a supporting surface for the human body, preferably has a depression which is adapted to the shape of the human body so that it is possible to lie in a very comfortable and relaxed manner. In addition, broader depressions can be provided in the top surface for the buttocks and head, so that the lounger or reclining chair can also be used by people of different sizes.

The lateral edges are provided with molded-on armrests which can be used not only for comfortably supporting the arms, but also, if the lateral edges are drawn downwards in the manner of floats, for stabilizing the floating position.

Furthermore the top surfaces of the armrests can be provided with recesses and/or surfaces for holding or depositing objects such as drinking vessels, suntan-cream containers and the like.

The front and rear ends of the plastic body are advantageously provided with handles which are intended for transport or can also be used to hold on to by people swimming in the water.

So that it is possible to move with the lounger or reclining chair, for example in order to keep a sufficient distance from a densely crowded beach, receiving supports for oars can preferably be provided on the sides. The receiving supports can have the form of push-through openings and can be used for mounting oar blades which are perpendicular in the water, which oar blades, during movement against the direction of travel, fold up, and open out in the direction of travel.

Figure 2:
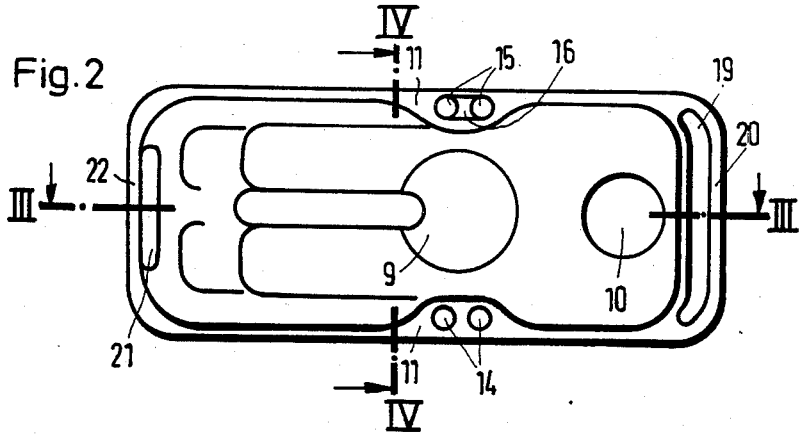
Figure 3:
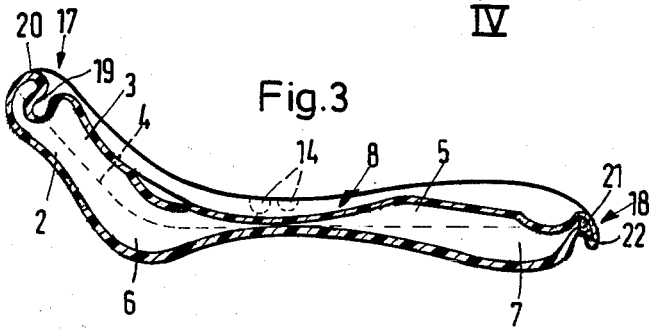
Figure 4:
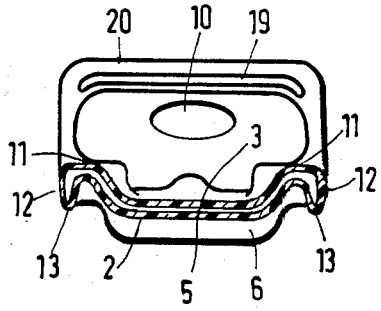

The invention is illustrated by way of example in the drawing and is described in detail below with reference to the drawing in which:

FIG. 1 is a perspective view of an example of embodiment of a floatable lounger, FIG. 2 is a top view of the lounger according to FIG. 1, FIG. 3 shows a section through the lounger along the line III—III in FIG. 2, and, FIG. 4 shows a section along the line IV—IV in FIG. 2.

The drawing shows a floatable lounger made from a rigid plastic body 1 which is composed of two single-piece half-shells 2 and 3. The two half-shells 2 and 3 are connected to each other in a watertight manner along their connecting line 4 and form between them a continuous cavity 5. The cavity 5 is used to provide the necessary buoyancy so that the lounger is not only floatable but is also able to support a human body.

The bottom half-shell is provided with two bulges 6 and 7, one in the back area and one in the foot area of the lounger, so that there is a considerable increase in the size of the cavity at these points and hence an increase in the buoyancy.

The top half-shell 3 is arched inwards slightly and has on its top surface which acts as a supporting surface a depression 8 which is adapted to the shape of the human body, so that the user can rest comfortably in the lounger. Furthermore, additional widened depressions 9 and 10 are provided on the top surface of the top half-shell for the buttocks and head, so that the lounger can also be used by people of varying sizes without lessening the comfort of the lounger.

Armrests 11, which improve the comfort of the lounger even more, are molded-on in the side areas of the lounger. The outer edges 12 of the arm rests 11 are drawn downwards slightly and form, in their lower areas, floats 13 which are immersed in the water when the lounger is used and hence, in the manner of lateral outriggers, produce a good floating stability.

The top surfaces of the armrests 11 are provided with various shaped recesses 14 and 15 which can be used for depositing or holding any objects which a user of the lounger may require. The recesses 14 are formed, for example, as hollow cylinders and can be used to hold a glass and a bottle. The recesses 15 have a relatively shallow shape and start from an already sunken storage surface 16, so that flat objects, such as cream containers and the like, can be comfortably placed in these recesses 15.

Handles 17 and 18 are provided at the head and foot ends of the lounger so that the lounger can easily be carried by two people.

The handle 17 provided at the head end consists of an elongated, pocket-shaped recess 19 into which one can insert the fingers and hence grasp an outer rim 20. During use of the lounger, the pocket-shaped recess 19 can also be used to hold magazines or the like, which can be firmly lodged there and, on account of the relatively high position, do not get wet.

The handle 18 provided at the foot end consists of an opening 21 which is in the form of a slit, is continuous from top to bottom and is bordered on its outside edge by a stationary gripping frame 22. In order to take hold of the lounger, one or both hands can be placed through the slot 21 and the frame 22 grasped.

Furthermore, the plastic body 1 can be provided with mountings 23 for oars in its side areas and particularly in the area of the armrests 11. These mountings may, for example, have the form of openings which are continuous from top to bottom and through which vertically positioned oars pass, the blades of which oars, during movement against the direction of travel, fold up, and open out in the direction of travel.

I claim:

1. A lounger or reclining chair comprising a rigid plastic body with a continuous supporting surface, said plastic body being floatable and means defining at least one cavity in said plastic body for making said lounger bouyant, the top surface of the plastic body defining a supporting surface, and having first a depression which is adapted to the shape of a human body and additional wider depressions than said first depression for the buttocks and head, said reclining chair including two lateral armrests, each armrest having two lateral edges, each lateral edge of each said armrest depending downwardly to form a float spaced from the central portion of said plastic body in the manner of lateral outriggers to produce floating stability.

2. Lounger or reclining chair as claimed in claim 1, wherein the plastic body consists of two single-piece half-shells, which are connected in a watertight manner to each other and define a continuous cavity between them.

3. Lounger or reclining chair, as claimed in claim 2, wherein the cavity has two bulges, one under the back area and one under the foot area.

4. Lounger or reclining chair as claimed in claim 2, wherein the cavity is packed with floatable material.

5. Lounger or reclining chair as claimed in claim 1, wherein recesses and/or surfaces (16) for depositing objects are provided in the top surfaces of the armrests.

6. Lounger or reclining chair as claimed in claim 1, wherein handles are provided at the front and rear ends of the plastic body (1) for transport.

7. Lounger or reclining chair as claimed in claim 1, further comprising lateral mountings for oars.

8. Lounger or reclining chair as claimed in claim 3, wherein the cavity is packed with floatable material.

* * * * *